US010718033B2

(12) United States Patent
Tabata et al.

(10) Patent No.: US 10,718,033 B2
(45) **Date of Patent: *Jul. 21, 2020**

(54) HEAT-TREATED STEEL MATERIAL AND METHOD OF MANUFACTURING THE SAME

(71) Applicant: NIPPON STEEL & SUMITOMO METAL CORPORATION, Tokyo (JP)

(72) Inventors: Shinichiro Tabata, Tokyo (JP); Kazuo Hikida, Tokyo (JP); Nobusato Kojima, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 726 days.

This patent is subject to a terminal disclaimer.

(21) Appl. No.: 15/311,473

(22) PCT Filed: May 26, 2015

(86) PCT No.: PCT/JP2015/065059

§ 371 (c)(1),
(2) Date: Nov. 15, 2016

(87) PCT Pub. No.: WO2015/182591

PCT Pub. Date: Dec. 3, 2015

(65) Prior Publication Data

US 2017/0081742 A1 Mar. 23, 2017

(30) Foreign Application Priority Data

May 29, 2014 (JP) ..... 2014-111455

(51) Int. Cl.

| | |
|---|---|
| ***C22C 38/02*** | (2006.01) |
| ***C21D 9/46*** | (2006.01) |
| ***C22C 38/00*** | (2006.01) |
| ***C21D 9/00*** | (2006.01) |
| ***B21D 22/20*** | (2006.01) |
| ***C22C 38/60*** | (2006.01) |
| ***C21D 8/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/34*** | (2006.01) |
| ***C22C 38/38*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| *C21D 1/18* | (2006.01) |

(52) U.S. Cl.

CPC ..... *C21D 9/46* (2013.01); *B21D 22/20* (2013.01); *C21D 8/0205* (2013.01); *C21D 9/00* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *C22C 38/38* (2013.01); *C22C 38/42* (2013.01); *C22C 38/44* (2013.01); *C22C 38/48* (2013.01); *C22C 38/50* (2013.01); *C22C 38/54* (2013.01); *C22C 38/58* (2013.01); *C22C 38/60* (2013.01); *C21D 1/18* (2013.01)

(58) Field of Classification Search

CPC ..... C22C 38/02; C21D 9/46

See application file for complete search history.

(56) References Cited

U.S. PATENT DOCUMENTS 10,196,726 B2 * 2/2019 Azuma ..... C21D 9/46
2006/0185774 A1 8/2006 Nishibata et al.
(Continued)

FOREIGN PATENT DOCUMENTS

CN 1829813 A 9/2006
CN 102822375 A 12/2012
(Continued)

OTHER PUBLICATIONS

Clarke et al., "Effect of Prior Microstrure and Heating Rate on Austenite Formation Kinetics in Three Steels for Induction Hardened Components . . . ," Retrieved from URL:http://citeseerx.ist.psu.edu/viewdoc/download?doi=10.1.1.523.4311&rep=REp1&type=pdf, Dec. 1, 2005, pp. 1-10.
(Continued)

*Primary Examiner* — Keith D. Hendricks
*Assistant Examiner* — Jophy S. Koshy
(74) *Attorney, Agent, or Firm* — Birch, Stewart, Kolasch & Birch, LLP

(57) ABSTRACT

A heat-treated steel material is provided having strength of 2.000 GPa or more. The heat-treated steel material includes a chemical composition represented by, in mass %: C: 0.05% to 0.30%; Si: 0.50% to 5.00%; Mn: 2.0% to 10.0%; Cr: 0.01% to 1.00%; Ti: 0.010% to 0.100%; B: 0.0020% to 0.0100%; P: 0.050% or less; S: 0.0500% or less; N: 0.0100% or less; Ni: 0% to 2.0%; each of Cu, Mo, and V: 0% to 1.0%; each of Al and Nb: 0% to 1.00%; and the balance: Fe and impurities. "4612×[C]+51×[Si]+102×[Mn]+605>2000" is satisfied. The heat-treated steel material includes a microstructure in which 90 volume % or more is formed of martensite, and a dislocation density in the martensite is equal to or more than $1.2\times10^{16}$ $m^{-2}$.

6 Claims, No Drawings

(56) References Cited

U.S. PATENT DOCUMENTS

| | | | | |
|---|---|---|---|---|
| 2010/0307641 | A1 | 12/2010 | Im et al. | |
| 2010/0307644 | A1 | 12/2010 | Gil Otin et al. | |
| 2010/0330388 | A1* | 12/2010 | Hara | B23K 9/0282 428/586 |
| 2014/0370329 | A1 | 12/2014 | Nonaka et al. | |
| 2015/0007911 | A1 | 1/2015 | Murakami et al. | |
| 2015/0013856 | A1 | 1/2015 | Murakami et al. | |
| 2015/0050519 | A1 | 2/2015 | Nonaka et al. | |
| 2015/0071812 | A1 | 3/2015 | Kawano et al. | |
| 2017/0067131 | A1* | 3/2017 | Fushiwaki | C21D 1/76 |
| 2017/0081741 | A1* | 3/2017 | Tabata | C22C 38/24 |

FOREIGN PATENT DOCUMENTS

| | | | |
|---|---|---|---|
| EP | 2610357 | A1 | 7/2013 |
| EP | 2 832 876 | A1 | 2/2015 |
| JP | 2002-102980 | A | 4/2002 |
| JP | 2006-152427 | A | 6/2006 |
| JP | 4513608 | B2 | 7/2010 |
| JP | 2011-505498 | A | 2/2011 |
| JP | 2012-1802 | A | 1/2012 |
| JP | 2012-180594 | A | 9/2012 |
| JP | 2013-104081 | A | 5/2013 |
| JP | 2013-185245 | A | 9/2013 |
| JP | 2013-185246 | A | 9/2013 |
| JP | 5387720 | B2 | 1/2014 |
| TW | 201346044 | A | 11/2013 |
| TW | 201413009 | A | 4/2014 |
| WO | WO 2011/118459 | A1 | 9/2011 |
| WO | WO 2013/105631 | A1 | 7/2013 |
| WO | WO 2013/105632 | A1 | 7/2013 |
| WO | WO 2013/133137 | A1 | 9/2013 |
| WO | WO-2014132968 | A1 * | 9/2014 |

OTHER PUBLICATIONS

Extended European Search Report for corresponding European Application No. 15799820.4, dated Jan. 5, 2018.

Muljono et al., "Influence of Heating Rate on a Anisothermal Recrystallization in Low and Ultra-Low Carbon Steels," Materials Science and Engineering A303, 2001, pp. 90-99.

International Preliminary Report on Patentability and the English translation of the Written Opinion of the International Searching Authority (Forms PCT/IB/338, PCT/IB/373 and PCT/ISA/237), dated Dec. 8, 2016, for International Application No. PCT/JP2015/065059.

Chinese Office Action and Search Report for corresponding Application No. 201580026153.6, dated Jul. 13, 2018.

Korean Office Action dated Feb. 26, 2018, issued in Korean Patent Application No. 10-2016-7032736.

International Search Report for PCT/JP2015/065059 (PCT/ISA/210) dated Aug. 25, 2015.

Written Opinion of the International Searching Authority for PCT/JP2015/065059 (PCT/ISA/237) dated Aug. 25, 2015.

Chinese Office Action dated Oct. 31, 2017, issued in corresponding Chinese Patent Application No. 201580026153.6.

* cited by examiner

HEAT-TREATED STEEL MATERIAL AND METHOD OF MANUFACTURING THE SAME

TECHNICAL FIELD

The present invention relates to a heat-treated steel material used for an automobile and the like, and a method of manufacturing the same.

BACKGROUND ART

A steel sheet for automobile is required to improve fuel efficiency and crashworthiness. Accordingly, attempts are being made to increase strength of the steel sheet for automobile. However, ductility such as press formability generally decreases in accordance with the improvement of strength, so that it is difficult to manufacture a component having a complicated shape. For example, in accordance with the decrease in ductility, a portion with a high working degree fractures, or springback and wall warp become large to deteriorate accuracy in size. Therefore, it is not easy to manufacture a component by press-forming a high-strength steel sheet, particularly, a steel sheet having tensile strength of 780 MPa or more.

Patent Literatures 1 and 2 describe a forming method called as a hot stamping method having an object to obtain high formability in a high-strength steel sheet. According to the hot stamping method, it is possible to form a high-strength steel sheet with high accuracy, and a steel material obtained through the hot stamping method also has high strength. Further, a microstructure of the steel material obtained through the hot stamping method is substantially made of a martensite single phase, and has excellent local deformability and toughness compared to a steel material obtained by performing cold forming on a high-strength steel sheet with multi-phase structure.

Generally, crushing strength when collision of an automobile occurs greatly depends on material strength. For this reason, in recent years, a demand regarding a steel material having tensile strength of 2.000 GPa or more, for example, has been increasing, and Patent Literature 3 describes a method having an object to obtain a steel material having tensile strength of 2.0 GPa or more.

According to the method described in Patent Literature 3, although it is possible to achieve the desired object, sufficient toughness and weldability cannot be obtained. Even with the use of the other conventional techniques such as steel sheets described in Patent literatures 4 to 7, and the like, it is not possible to obtain tensile strength of 2.000 GPa or more while achieving excellent toughness and weldability.

CITATION LIST

Patent Literature

Patent Literature 1: Japanese Laid-open Patent Publication No. 2002-102980

Patent Literature 2: Japanese Laid-open Patent Publication No. 2012-180594

Patent Literature 3: Japanese Laid-open Patent Publication No. 2012-1802

Patent Literature 4: Japanese Translation of PCT International Application Publication No. 2011-505498

Patent Literature 5: Japanese Laid-open Patent Publication No. 2006-152427

Patent Literature 6: International Publication Pamphlet No. WO 2013/105631

Patent Literature 7: Japanese Laid-open Patent Publication No. 2013-104081

SUMMARY OF INVENTION

Technical Problem

The present invention has an object to provide a heat-treated steel material capable of obtaining tensile strength of 2.000 GPa or more while achieving excellent toughness and weldability, and a method of manufacturing the same.

Solution to Problem

As a result of earnest studies to solve the above problems, the present inventors found out that when a heat-treated steel material contains specific amounts of C, Si, and Mn, it is possible to obtain strength of 2.000 GPa or more with obtaining excellent toughness and weldability, although details thereof will be described later.

The higher a C content, the higher a dislocation density in martensite and finer substructures (lath, block, packet) in a prior austenite grain. Based on the above description, it is considered that a factor other than solid-solution strengthening of C also greatly contributes to the strength of martensite. The mechanism by which dislocation occurs in the martensite and the mechanism by which the substructures become fine, is estimated as follows. Transformation from austenite to martensite is accompanied by expansion, so that in accordance with martensite transformation, strain (transformation strain) is introduced into surrounding non-transformed austenite, and in order to lessen the transformation strain, the martensite right after the transformation undergoes supplemental deformation. On this occasion, since the transformation strain in austenite strengthened by C is large, fine lath and block are generated to reduce the transformation strain, and the martensite undergoes supplemental deformation while being subjected to introduction of a large number of dislocations. It is estimated that, because of such mechanisms, the dislocation density in the martensite is high, and the substructures in the prior austenite grain become fine.

The present inventors found out, based on the above-described estimation, that the dislocation density increases, crystal grains become fine, and the tensile strength dramatically increases, in accordance with quenching, also when a steel sheet contains Mn, which introduces a compressive strain into a surrounding lattice similarly to C.

Specifically, the present inventors found out that when a heat-treated steel material including martensite as its main structure contains a specific amount of Mn, the steel material is affected by indirect strengthening such as dislocation strengthening and grain refinement strengthening, in addition to solid-solution strengthening of Mn, resulting in that desired tensile strength can be obtained. Further, it has been clarified by the present inventors that in a heat-treated steel material including martensite as its main structure, Mn has strengthening property of about 100 MPa/mass % including the above-described indirect strengthening.

It has been conventionally considered that the strength of martensite mainly depends on the solid-solution strengthening property of C, and there is no influence of an alloying element almost at all (for example, Leslie et al., Iron & Steel Material Science, Maruzen, 1985), so that it has not been known that Mn exerts large influence on the improvement of strength of the heat-treated steel material.

Then, based on these findings, the inventors of the present application reached the following various embodiments of the invention.

(1)

A heat-treated steel material, including:

a chemical composition represented by, in mass %:

C: 0.05% to 0.30%;
Si: 0.50% to 5.00%;
Mn: 2.0% to 10.0%;
Cr: 0.01% to 1.00%;
Ti: 0.010% to 0.100%;
B: 0.0020% to 0.0100%;
P: 0.050% or less;
S: 0.0500% or less;
N: 0.0100% or less;
Ni: 0.0% to 2.0%;
Cu: 0.0% to 1.0%;
Mo: 0.0% to 1.0%;
V: 0.0% to 1.0%;
Al: 0.00% to 1.00%;
Nb: 0.00% to 1.00%; and
the balance: Fe and impurities, and a microstructure represented by martensite: 90 volume % or more, wherein an "Expression 1" is satisfied where [C] denotes a C content (mass %), [Si] denotes a Si content (mass %), and [Mn] denotes a Mn content (mass %), $$4612\times[C]+51\times[Si]+102\times[Mn]+605\geq 2000 \quad \text{"Expression 1";}$$

wherein a dislocation density in the martensite is equal to or more than $1.2\times10^{16}$ $m^{-2}$; and wherein a tensile strength is 2.000 GPa or more.

(2)

The heat-treated steel material according to (1), wherein in the chemical composition, Ni: 0.1% to 2.0%,
Cu: 0.1% to 1.0%,
Mo: 0.1% to 1.0%,
V: 0.1% to 1.0%,
Al: 0.01% to 1.00%, or
Nb: 0.01% to 1.00%, or
any combination thereof is satisfied.

(3)

A method of manufacturing a heat-treated steel material, including:

heating a steel sheet to a temperature zone of not less than an $Ac_3$ point nor more than "the $Ac_3$ point+200° C." at an average heating rate of 10° C./s or more;

next, cooling the steel sheet from the temperature zone to an Ms point at a rate equal to or more than an upper critical cooling rate; and next, cooling the steel sheet from the Ms point to 100° C. at an average cooling rate of 50° C./s or more, wherein the steel sheet includes a chemical composition represented by, in mass %:

C: 0.05% to 0.30%;
Si: 0.50% to 5.00%;
Mn: 2.0% to 10.0%;
Cr: 0.01% to 1.00%;
Ti: 0.010% to 0.100%;
B: 0.0020% to 0.0100%;
P: 0.050% or less;
S: 0.0500% or less;
N: 0.0100% or less;
Ni: 0.0% to 2.0%;
Cu: 0.0% to 1.0%;
Mo: 0.0% to 1.0%;
V: 0.0% to 1.0%;
Al: 0.00% to 1.00%;
Nb: 0.00% to 1.00%; and
the balance: Fe and impurities, wherein an "Expression 1" is satisfied where [C] denotes a C content (mass %), [Si] denotes a Si content (mass %), and [Mn] denotes a Mn content (mass %), $$4612\times[C]+51\times[Si]+102\times[Mn]+605\geq 2000 \quad \text{"Expression 1".}$$

(4)

The method of manufacturing the heat-treated steel material according to (3), wherein in the chemical composition, Ni: 0.1% to 2.0%,
Cu: 0.1% to 1.0%,
Mo: 0.1% to 1.0%,
V: 0.1% to 1.0%,
Al: 0.01% to 1.00%, or
Nb: 0.01% to 1.00% or
any combination thereof is satisfied.

(5)

The method of manufacturing the heat-treated steel material according to (3) or (4), wherein the steel sheet is subjected to forming before the temperature of the steel sheet reaches the Ms point after the heating the steel sheet to the temperature zone of not less than the $Ac_3$ point nor more than "the $Ac_3$ point+200° C.".

Advantageous Effects of Invention

According to the present invention, it is possible to obtain strength of 2.000 GPa or more with obtaining excellent toughness and weldability.

DESCRIPTION OF EMBODIMENTS

Hereinafter, an embodiment of the present invention will be described. Although details will be described later, a heat-treated steel material according to the embodiment of the present invention is manufactured by quenching a specific steel sheet for heat treatment. Therefore, hardenability of the steel sheet for heat treatment and a quenching condition exert influence on the heat-treated steel material.

First, a chemical composition of the heat-treated steel material according to the embodiment of the present invention and the steel sheet for heat treatment used for manufacturing the heat-treated steel material will be described. In the following description, "%" being a unit of content of each element contained in the heat-treated steel material and the steel sheet used for manufacturing the heat-treated steel material means "mass %" unless otherwise mentioned. The heat-treated steel material according to the present embodiment and the steel sheet used for manufacturing the heat-treated steel material includes a chemical composition represented by C: 0.05% to 0.30%, Si: 0.50% to 5.00%, Mn: 2.0% to 10.0%, Cr: 0.01% to 1.00%, Ti: 0.010% to 0.100%, B: 0.0020% to 0.0100%, P: 0.050% or less, S: 0.0500% or less, N: 0.0100% or less, Ni: 0.0% to 2.0%, Cu: 0.0% to 1.0%, Mo: 0.0% to 1.0%, V: 0.0% to 1.0%, Al: 0.00% to 1.00%, Nb: 0.00% to 1.00%, and the balance: Fe and impurities, and an "Expression 1" is satisfied where [C] denotes a C content (mass %), [Si] denotes a Si content (mass %), and [Mn] denotes a Mn content (mass %). Examples of the impurities are those contained in a raw material such as an ore or scrap, and those contained during manufacturing processes.

$$4612\times[C]+51\times[Si]+102\times[Mn]+605\geq 2000 \quad \text{"Expression 1";}$$

(C: 0.05% to 0.30%)

C is an element that enhances hardenability of the steel sheet for heat treatment and improves strength of the heat-treated steel material. If the C content is less than 0.05%, the strength of the heat-treated steel material is not sufficient. Thus, the C content is 0.05% or more. The C content is preferably 0.08% or more. On the other hand, if the C content exceeds 0.30%, the strength of the heat-treated steel material is too high, resulting in that toughness and weldability significantly deteriorate. Thus, the C content is 0.30% or less. The C content is preferably 0.28% or less, and more preferably 0.25% or less.

(Si: 0.50% to 5.00%)

Si is an element that enhances the hardenability of the steel sheet for heat treatment and improves the strength of the heat-treated steel material. Si also has an effect of improving the strength of the heat-treated steel material through solid-solution strengthening. If the Si content is less than 0.50%, the strength of the heat-treated steel material is not sufficient. Thus, the Si content is 0.50% or more. The Si content is preferably 0.75% or more. On the other hand, if the Si content exceeds 5.00%, a temperature at which austenite transformation occurs is significantly high. As this temperature is higher, a cost required for heating for quenching increases, or quenching is likely to be insufficient due to insufficient heating. Thus, the Si content is 5.00% or less. The Si content is preferably 4.00% or less.

(Mn: 2.0% to 10.0%)

Mn is an element which enhances the hardenability of the steel sheet for heat treatment. Mn strengthens martensite through not only solid-solution strengthening but also facilitation of introduction of a large number of dislocations during martensite transformation, which occurs when manufacturing the heat-treated steel material. Specifically, Mn has an effect of facilitating the dislocation strengthening. Mn refines substructures in a prior austenite grain after the martensite transformation through the introduction of dislocations, to thereby strengthen the martensite. Specifically, Mn also has an effect of facilitating grain refinement strengthening. Therefore, Mn is a particularly important element. If the Mn content is less than 2.0% where the C content is 0.05% to 0.30%, the effect by the above function cannot be sufficiently obtained, resulting in that the strength of the heat-treated steel material is not sufficient. Thus, the Mn content is 2.0% or more. The Mn content is preferably 2.5% or more, and more preferably 3.6% or more. On the other hand, if the Mn content exceeds 10.0%, the strength of the heat-treated steel material is too high, resulting in that toughness and hydrogen embrittlement resistance significantly deteriorate. Thus, the Mn content is 10.0% or less. The Mn content is preferably 9.0% or less. A strengthening property of Mn in the heat-treated steel material including martensite as its main structure is about 100 MPa/mass %, which is about 2.5 times a strengthening property of Mn in a steel material including ferrite as its main structure (about 40 MPa/mass %).

(Cr: 0.01% to 1.00%)

Cr is an element which enhances the hardenability of the steel sheet for heat treatment, thereby enabling to stably obtain the strength of the heat-treated steel material. If the Cr content is less than 0.01%, there is a case where the effect by the above function cannot be sufficiently obtained. Thus, the Cr content is 0.01% or more. The Cr content is preferably 0.02% or more. On the other hand, if the Cr content exceeds 1.00%, Cr concentrates in carbides in the steel sheet for heat treatment, resulting in that the hardenability lowers. This is because, as Cr concentrates, the carbides are more stabilized, and the carbides are less solid-soluble during heating for quenching. Thus, the Cr content is 1.00% or less. The Cr content is preferably 0.80% or less.

(Ti: 0.010% to 0.100%)

Ti has an effect of greatly improving the toughness of the heat-treated steel material. Namely, Ti suppresses recrystallization and further forms fine carbides to suppress grain growth of austenite during heat treatment for quenching at a temperature of an $Ac_3$ point or higher. Fine austenite grains are obtained by the suppression of the grain growth, resulting in that the toughness greatly improves. Ti also has an effect of preferentially bonding with N in the steel sheet for heat treatment, thereby suppressing B from being consumed by the precipitation of BN. As will be described later, B has an effect of improving the hardenability, so that it is possible to securely obtain the effect of improving the hardenability by B through suppressing the consumption of B. If the Ti content is less than 0.010%, there is a case where the effect by the above function cannot be sufficiently obtained. Thus, the Ti content is 0.010% or more. The Ti content is preferably 0.015% or more. On the other hand, if the Ti content exceeds 0.100%, a precipitation amount of TiC increases so that C is consumed, and accordingly, there is a case where the heat-treated steel material cannot obtain sufficient strength. Thus, the Ti content is 0.100% or less. The Ti content is preferably 0.080% or less.

(B: 0.0020% to 0.0100%)

B is a very important element having an effect of significantly enhancing the hardenability of the steel sheet for heat treatment. B also has an effect of strengthening a grain boundary to increase the toughness by segregating in the grain boundary. B also has an effect of improving the toughness by suppressing the grain growth of austenite during heating of the steel sheet for heat treatment. If the B content is less than 0.0020%, there is a case where the effect by the above function cannot be sufficiently obtained. Thus, the B content is 0.0020% or more. The B content is preferably 0.0025% or more. On the other hand, if the B content exceeds 0.0100%, a large amount of coarse compounds precipitate to deteriorate the toughness of the heat-treated steel material. Thus, the B content is 0.0100% or less. The B content is preferably 0.0080% or less.

(P: 0.050% or less)

P is not an essential element, but is contained in the steel as impurities, for example. P deteriorates the toughness of the heat-treated steel material. Therefore, the lower the P content, the better. In particular, when the P content exceeds 0.050%, the toughness noticeably lowers. Thus, the P content is 0.050% or less. The P content is preferably 0.005% or less. It requires a considerable cost to decrease the P content to less than 0.001%, and it sometimes requires a more enormous cost to decrease the P content to less than 0.001%. Thus, there is no need to decrease the P content to less than 0.001%.

(S: 0.0500% or less)

S is not an essential element, but is contained in the steel as impurities, for example. S deteriorates the toughness of the heat-treated steel material. Therefore, the lower the S content, the better. In particular, when the S content exceeds 0.0500%, the toughness noticeably lowers. Thus, the S content is 0.0500% or less. The S content is preferably 0.0300% or less. It requires a considerable cost to decrease the S content to less than 0.0002%, and it sometimes requires a more enormous cost to decrease the S content to less than 0.0002%. Thus, there is no need to decrease the S content to less than 0.0002%.

(N: 0.0100% or less)

N is not an essential element, but is contained in the steel as impurities, for example. N contributes to the formation of a coarse nitride and deteriorates local deformability and the toughness of the heat-treated steel material. Therefore, the lower the N content, the better. In particular, when the N content exceeds 0.0100%, the local deformability and the toughness noticeably lower. Thus, the N content is 0.0100% or less. It requires a considerable cost to decrease the N content to less than 0.0008%. Thus, there is no need to decrease the N content to less than 0.0008%. It sometimes requires a more enormous cost to decrease the N content to less than 0.0002%.

Ni, Cu, Mo, V, Al, and Nb are not essential elements, but are optional elements which may be appropriately contained, up to a specific amount as a limit, in the steel sheet for heat treatment and the heat-treated steel material.

(Ni: 0.0% to 2.0%, Cu: 0.0% to 1.0%, Mo: 0.0% to 1.0%, V: 0.0% to 1.0%, Al: 0.00% to 1.00%, Nb: 0.00% to 1.00%)

Ni, Cu, Mo, V, Al, and Nb are elements which enhance the hardenability of the steel sheet for heat treatment, thereby enabling to stably obtain the strength of the heat-treated steel material. Thus, one or any combination selected from the group consisting of these elements may be contained. However, if the Ni content exceeds 2.0%, the effect by the above function saturates, which only increases a wasteful cost. Thus, the Ni content is 2.0% or less. If the Cu content exceeds 1.0%, the effect by the above function saturates, which only increases a wasteful cost. Thus, the Cu content is 1.0% or less. If the Mo content exceeds 1.0%, the effect by the above function saturates, which only increases a wasteful cost. Thus, the Mo content is 1.0% or less. If the V content exceeds 1.0%, the effect by the above function saturates, which only increases a wasteful cost. Thus, the V content is 1.0% or less. If the Al content exceeds 1.00%, the effect by the above function saturates, which only increases a wasteful cost. Thus, the Al content is 1.00% or less. If the Nb content exceeds 1.00%, the effect by the above function saturates, which only increases a wasteful cost. Thus, the Nb content is 1.00% or less. In order to securely obtain the effect by the above function, each of the Ni content, the Cu content, the Mo content, and the V content is preferably 0.1% or more, and each of the Al content and the Nb content is preferably 0.01% or more. Namely, it is preferable to satisfy one or any combination of the following: "Ni: 0.1% to 2.0%", "Cu: 0.1% to 1.0%", "Mo: 0.1% to 1.0%", "V: 0.1% to 1.0%", "Al: 0.01% to 1.00%", or "Nb: 0.01% to 1.00%".

As described above, C, Si, and Mn increase the strength of the heat-treated steel material mainly by increasing the strength of martensite. However, it is not possible to obtain tensile strength of 2.000 GPa or more, if the "Expression 1" is not satisfied where [C] denotes a C content (mass %), [Si] denotes a Si content (mass %), and [Mn] denotes a Mn content (mass %). Accordingly, the "Expression 1" should be satisfied.

$$4612\times[C]+51\times[Si]+102\times[Mn]+605\geq 2000 \quad \text{"Expression 1"};$$

Next, a microstructure of the heat-treated steel material according to the present embodiment will be described. The heat-treated steel material according to the present embodiment includes a microstructure represented by martensite: 90 volume % or more. The balance of the microstructure is, for example, retained austenite. When the microstructure is formed of martensite and retained austenite, a volume fraction (volume %) of the martensite may be measured through an X-ray diffraction method with high accuracy. Specifically, diffracted X-rays obtained by the martensite and the retained austenite are detected, and the volume fraction may be measured based on an area ratio of the diffraction curve. When the microstructure includes another phase such as ferrite, an area ratio (area %) of the other phase is measured through microscopic observation, for example. The structure of the heat-treated steel material is isotropic, so that a value of an area ratio of a phase obtained at a certain cross section may be regarded to be equivalent to a volume fraction in the heat-treated steel material. Thus, the value of the area ratio measured through the microscopic observation may be regarded as the volume fraction (volume %).

Next, a dislocation density in martensite in the heat-treated steel material according to the present embodiment will be described. The dislocation density in the martensite contributes to the improvement of tensile strength. When the dislocation density in the martensite is less than $1.2\times10^{16}$ $m^{-2}$, it is not possible to obtain the tensile strength of 2.000 GPa or more. Thus, the dislocation density in the martensite is $1.2\times10^{16}$ $m^{-2}$ or more.

The dislocation density may be calculated through an evaluation method based on the Williamson-Hall method, for example. The Williamson-Hall method is described in "G. K. Williamson and W. H. Hall: Acta Metallurgica, 1(1953), 22", "G. K. Williamson and R. E. Smallman: Philosophical Magazine, 8(1956), 34", and others, for example. Concretely, peak fitting of respective diffraction spectra of a {200} plane, a {211} plane, and a {220} plane of body-centered cubic structure is carried out, and $\beta\times\cos\theta/\lambda$ is plotted on a horizontal axis, and $\sin\theta/\lambda$ is plotted on a vertical axis based on each peak position ($\theta$) and half-width ($\beta$). An inclination obtained from the plotting corresponds to local strain $\varepsilon$, and the dislocation density $\rho$ ($m^{-2}$) is determined based on a following "Expression 2" proposed by Wlliamson, Smallman, et al. Here, b denotes a magnitude of Burgers vector (nm).

$$p=14.4\times\varepsilon^2/b^2 \quad \text{"Expression 2"}$$

Further, the heat-treated steel material according to the present embodiment has the tensile strength of 2.000 GPa or more. The tensile strength may be measured based on rules of ASTM standard E8, for example. In this case, when producing test pieces, soaked portions are polished until their thicknesses become 1.2 mm, to be worked into half-size plate-shaped test pieces of ASTM standard E8, so that a tensile direction is parallel to the rolling direction. A length of a parallel portion of each of the half-size plate-shaped test pieces is 32 mm, and a width of the parallel portion is 6.25 mm. Then, a strain gage is attached to each of the test pieces, and a tensile test is conducted at a strain rate of 3 mm/min at room temperature.

Next, a method of manufacturing the heat-treated steel material, namely, a method of treating the steel sheet for heat treatment, will be described. In the treatment of the steel sheet for heat treatment, the steel sheet for heat treatment is heated to a temperature zone of not less than an $Ac_3$ point nor more than "the $Ac_3$ point+200° C." at an average heating rate of 10° C./s or more, the steel sheet is then cooled from the temperature zone to an Ms point at a rate equal to or more than an upper critical cooling rate, and thereafter, the steel sheet is cooled from the Ms point to 100° C. at an average cooling rate of 50° C./s or more.

If the steel sheet for heat treatment is heated to the temperature zone of the $Ac_3$ point or more, the structure becomes an austenite single phase. If the average heating rate is less than 10° C./s, there is a case that an austenite grain becomes excessively coarse, or the dislocation density lowers due to recovery, thereby deteriorating the strength and the toughness of the heat-treated steel material. Thus, the average heating rate is 10° C./s or more. The average heating rate is preferably 20° C./s or more, and more preferably 50° C./s or more. When the reaching temperature of the heating exceeds "the $Ac_3$ point+200° C.", there is a case that an austenite grain becomes excessively coarse, or the dislocation density lowers, thereby deteriorating the strength and the toughness of the heat-treated steel material. Thus, the reaching temperature is "the $Ac_3$ point+200° C." or less.

The above-described series of heating and cooling may also be carried out by, for example, a hot stamping method, in which heat treatment and hot forming are conducted concurrently, or high-frequency heating and quenching. The period of time of retention of the steel sheet in the temperature zone of not less than the $Ac_3$ point nor more than "the $Ac_3$ point+200° C." is preferably 30 seconds or more, from a viewpoint of increasing the hardenability of steel by accelerating the austenite transformation to dissolve carbides. The retention time is preferably 600 seconds or less, from a viewpoint of productivity.

If the steel sheet is cooled from the temperature zone to the Ms point at the rate equal to or more than the upper critical cooling rate after being subjected to the above-described heating, the structure of the austenite single phase is maintained, without occurrence of diffusion transformation. If the cooling rate is less than the upper critical cooling rate, the diffusion transformation occurs so that ferrite is easily generated, resulting in that the microstructure in which the volume fraction of martensite is 90 volume % or more is not be obtained. Thus, the cooling rate to the Ms point is equal to or more than the upper critical cooling rate.

If the steel sheet is cooled from the Ms point to 100° C. at the average cooling rate of 50° C./s or more after the cooling to the Ms point, the transformation from austenite to martensite occurs, resulting in that the microstructure in which the volume fraction of martensite is 90 volume % or more can be obtained. As described above, the transformation from austenite to martensite is accompanied by expansion, so that in accordance with the martensite transformation, strain (transformation strain) is introduced into surrounding non-transformed austenite, and in order to lessen the transformation strain, the martensite right after the transformation undergoes supplemental deformation. Concretely, the martensite undergoes slip deformation while being subjected to introduction of dislocations. Consequently, the martensite includes high-density dislocations. In the present embodiment, the specific amounts of C, Si, and Mn are contained, so that the dislocations are generated in the martensite at extremely high density, and the dislocation density becomes $1.2\times10^{16}$ $m^{-2}$ or more. If the average cooling rate from the Ms point to 100° C. is less than 50° C./s, recovery of dislocations easily occurs in accordance with auto-tempering, resulting in that the dislocation density becomes insufficient and the sufficient tensile strength cannot be obtained. Thus, the average cooling rate is 50° C./s or more. The average cooling rate is preferably 100° C./s or more, and more preferably 500° C./s or more.

In the manner as described above, the heat-treated steel material according to the present embodiment provided with the excellent toughness and weldability, and the tensile strength of 2.000 GPa or more, can be manufactured. An average grain diameter of prior austenite grains in the heat-treated steel material is about 10 μm to 20 μm.

A cooling rate from less than 100° C. to the room temperature is preferably a rate of air cooling or more. If the cooling rate is less than the air cooling rate, there is a case that the tensile strength lowers due to the influence of auto-tempering.

It is also possible to perform hot forming such as the hot stamping described above, during the above-described series of heating and cooling. Specifically, the steel sheet for heat treatment may be subjected to forming in a die before the temperature of the steel sheet reaches the Ms point after the heating to the temperature zone of not less than the $Ac_3$ point nor more than "the $Ac_3$ point+200° C.". Bending, drawing, bulging, hole expansion, and flanging may be cited as examples of the hot forming. These belong to press forming, but, as long as it is possible to cool the steel sheet in parallel with the hot forming or right after the hot forming, hot forming other than the press forming, such as roll forming, may also be performed.

The steel sheet for heat treatment may be a hot-rolled steel sheet or a cold-rolled steel sheet. An annealed hot-rolled steel sheet or an annealed cold-rolled steel sheet obtained by performing annealing on a hot-rolled steel sheet or a cold-rolled steel sheet may also be used as the steel sheet for heat treatment.

The steel sheet for heat treatment may be a surface-treated steel sheet such as a plated steel sheet. Namely, a plating layer may be provided on the steel sheet for heat treatment. The plating layer contributes to improvement of corrosion resistance and the like, for example. The plating layer may be an electroplating layer or a hot-dip plating layer. An electrogalvanizing layer and a Zn—Ni alloy electroplating layer may be cited as examples of the electroplating layer. A hot-dip galvanizing layer, an alloyed hot-dip galvanizing layer, a hot-dip aluminum plating layer, a hot-dip Zn—Al alloy plating layer, a hot-dip Zn—Al—Mg alloy plating layer, and a hot-dip Zn—Al—Mg—Si alloy plating layer may be cited as examples of the hot-dip plating layer. A coating amount of the plating layer is not particularly limited, and may be a coating amount within an ordinary range, for example. Similarly to the steel sheet for heat treatment, the heat-treated steel material may be provided with a plating layer.

Note that any one of the above-described embodiments only presents concrete examples in carrying out the present invention, and the technical scope of the present invention should not be construed in a limited manner by these. That is, the present invention may be embodied in various forms without departing from its technical idea or its main feature.

EXAMPLES

Next, experiments conducted by the inventors of the present application will be described.

In the experiment, slabs each including a chemical composition presented in Table 1 were subjected to hot-rolling and cold-rolling, to thereby manufacture cold-rolled steel sheets each including a thickness of 1.4 mm, as steel sheets for heat treatment. Blank columns in Table 1 indicate that contents of elements in the blank columns are less than detection limits, and the balance is Fe and impurities. Underlines in Table 1 indicate that the underlined numerical values are out of the ranges of the present invention.

TABLE 1

| STEEL No. | CHEMICAL COMPOSITION (MASS %) C | Si | Mn | Cr | Ti | B | P | S | N | Ni | Cu | Mo | V | Al | Nb | TRANSFORMATION TEMPERATURE (° C.) $Ac_3$ POINT | Ms POINT | LEFT SIDE OF "EXPRESSION 1" |
|---|---|---|---|---|---|---|---|---|---|---|---|---|---|---|---|---|---|---|
| 1 | 0.08 | 3.00 | 9.0 | 0.02 | 0.015 | 0.0022 | 0.012 | 0.0018 | 0.0032 | | | | | | | 840 | 165 | 2045 |
| 2 | 0.10 | 2.80 | 8.5 | 0.11 | 0.016 | 0.0024 | 0.011 | 0.0016 | 0.0026 | | | 0.2 | | 0.03 | | 834 | 176 | 2076 |
| 3 | 0.13 | 2.80 | 7.2 | 0.12 | 0.016 | 0.0031 | 0.009 | 0.0012 | 0.0031 | | | | 0.2 | | 0.10 | 853 | 213 | 2082 |
| 4 | 0.16 | 2.70 | 6.6 | 0.08 | 0.020 | 0.0025 | 0.016 | 0.0021 | 0.0035 | 0.3 | 0.1 | | | | | 860 | 225 | 2154 |
| 5 | 0.21 | 1.70 | 5.2 | 0.31 | 0.021 | 0.0026 | 0.012 | 0.0014 | 0.0031 | | | | | | | 813 | 260 | 2191 |
| 6 | 0.25 | 1.60 | 3.6 | 0.14 | 0.025 | 0.0029 | 0.011 | 0.0009 | 0.0032 | | | 0.1 | | | | 843 | 312 | 2207 |
| 7 | 0.28 | 2.00 | 2.1 | 0.15 | 0.025 | 0.0028 | 0.008 | 0.0011 | 0.0032 | | 0.1 | | | | | 890 | 350 | 2213 |
| 8 | 0.25 | 0.30 | 1.2 | 0.21 | 0.022 | 0.0031 | 0.009 | 0.0016 | 0.0036 | | | | | 0.06 | | 818 | 407 | 1896 |
| 9 | 0.28 | 0.70 | 0.1 | 0.26 | 0.026 | 0.0019 | 0.012 | 0.0013 | 0.0028 | | | 0.1 | | 0.04 | 0.20 | 867 | 432 | 1942 |
| 10 | 0.03 | 4.00 | 9.0 | 0.31 | 0.023 | 0.0021 | 0.016 | 0.0018 | 0.0031 | 0.2 | | 0.2 | | 0.07 | | 938 | 173 | 1865 |
| 11 | 0.10 | 2.00 | 6.0 | 0.25 | 0.025 | 0.0022 | 0.012 | 0.0014 | 0.0037 | 0.3 | | | | | 0.20 | 843 | 273 | 1780 |

Then, samples each including a thickness of 1.4 mm, a width of 30 mm, and a length of 200 mm were produced from the respective cold-rolled steel sheets, and the samples were heated and cooled under conditions presented in Table 2. The heating and cooling imitate heat treatment in hot forming. The heating in the experiment was performed by energization heating. After the cooling, soaked portions were cut out from the samples, and the soaked portions were subjected to a tensile test and an X-ray diffraction test.

The tensile test was conducted based on rules of ASTM standard E8. In the tensile test, a tensile LesLer made by Instron corporation was used. When preparing test pieces, soaking portions were polished until their thicknesses became 1.2 mm, to be worked into half-size plate-shaped test pieces of ASTM standard E8, so that a tensile direction was parallel to the rolling direction. A length of a parallel portion of each of the half-size plate-shaped test pieces was 32 mm, and a width of the parallel portion was 6.25 mm. Then, a strain gage was attached to each of the test pieces, and a tensile test was conducted at a strain rate of 3 mm/min at room temperature. As the strain gage, KFG-5 (gage length: 5 mm) made by KYOWA ELECTRONIC INSTRUMENTS CO., LTD. was used.

In the X-ray diffraction test, portions up to a depth of 0.1 mm from surfaces of the soaked portions were chemically polished by using hydrofluoric acid and a hydrogen peroxide solution, thereby preparing test pieces for the X-ray diffraction test each having a thickness of 1.1 mm. Then, a Co tube was used to obtain an X-ray diffraction spectrum of each of the test pieces in a range of 20 from 45° to 130°, and a dislocation density was determined from the X-ray diffraction spectrum. Further, volume fractions of martensite were also determined based on the detection results of the diffracted X-rays and results of observation by optical microscope according to need in addition to the results of the diffracted X-rays.

The dislocation density was calculated through the evaluation method based on the above-described Williamson-Hall method. Concretely, in this experiment, peak fitting of respective diffraction spectra of a {200} plane, a {211} plane, and a {220} plane of body-centered cubic structure was carried out, and $\beta \times \cos\theta/\lambda$ was plotted on a horizontal axis and $\sin\theta/\lambda$ was plotted on a vertical axis based on each peak position ($\theta$) and half-width ($\beta$). Then, the dislocation density $\rho$ ($m^{-2}$) was determined based on the "Expression 2".

Results of these are presented in Table 2. Underlines in Table 2 indicate that the underlined numerical values are out of the ranges of the present invention.

TABLE 2

| SAMPLE No. | STEEL No. | HEATING: AVERAGE HEATING RATE (° C./s) | HEATING: REACHING TEMPERATURE (° C.) | COOLING: COOLING RATE FROM REACHING TEMPERATURE TO Ms POINT (° C./s) | COOLING: AVERAGE COOLING RATE FROM Ms POINT TO 100° C. (° C./s) | VOLUME FRACTION OF MARTENSITE (VOLUME %) | DISLOCATION DENSITY ($m^{-2}$) | TENSILE STRENGTH (GPa) | REMARKS |
|---|---|---|---|---|---|---|---|---|---|
| 1 | 1 | 10 | 900 | 80 | 2001 | 99 | $1.2 \times 10^{16}$ | 2.045 | EXAMPLE |
| 2 | 2 | 10 | 900 | 80 | 2050 | 98 | $1.2 \times 10^{16}$ | 2.076 | EXAMPLE |
| 3 | 3 | 10 | 900 | 80 | 2035 | 99 | $1.2 \times 10^{16}$ | 2.082 | EXAMPLE |
| 4 | 4 | 12 | 900 | 79 | 2012 | 99 | $1.5 \times 10^{16}$ | 2.096 | EXAMPLE |
| 5 | | 26 | 900 | 65 | 800 | 97 | $1.4 \times 10^{16}$ | 2.056 | EXAMPLE |
| 6 | | 24 | 900 | 66 | 250 | 97 | $1.3 \times 10^{16}$ | 2.023 | EXAMPLE |
| 7 | | 16 | 900 | 68 | 10 | 96 | $1.1 \times 10^{16}$ | 1.926 | COMPARATIVE EXAMPLE |
| 8 | | 19 | 900 | 72 | 5 | 94 | $1.1 \times 10^{16}$ | 1.904 | COMPARATIVE EXAMPLE |

TABLE 2-continued

| SAMPLE No. | STEEL No. | HEATING: AVERAGE HEATING RATE (° C./s) | HEATING: REACHING TEMPERATURE (° C.) | COOLING: COOLING RATE FROM REACHING TEMPERATURE TO Ms POINT (° C./s) | COOLING: AVERAGE COOLING RATE FROM Ms POINT TO 100° C. (° C./s) | VOLUME FRACTION OF MARTENSITE (VOLUME %) | DISLOCATION DENSITY ($m^{-2}$) | TENSILE STRENGTH (GPa) | REMARKS |
|---|---|---|---|---|---|---|---|---|---|
| 9 | | 2 | 1100 | 80 | 400 | 96 | $9.5 \times 10^{15}$ | 1.850 | COMPARATIVE EXAMPLE |
| 10 | 5 | 16 | 900 | 79 | 2010 | 100 | $1.5 \times 10^{16}$ | 2.108 | EXAMPLE |
| 11 | | 14 | 900 | 69 | 550 | 98 | $1.4 \times 10^{16}$ | 2.057 | EXAMPLE |
| 12 | | 19 | 900 | 65 | 400 | 97 | $1.4 \times 10^{16}$ | 2.048 | EXAMPLE |
| 13 | | 26 | 900 | 75 | 82 | 96 | $1.3 \times 10^{16}$ | 2.001 | EXAMPLE |
| 14 | | 22 | 900 | 77 | 3 | 94 | $1.0 \times 10^{16}$ | 1.891 | COMPARATIVE EXAMPLE |
| 15 | | 3 | 1100 | 65 | 200 | 96 | $9.7 \times 10^{15}$ | 1.870 | COMPARATIVE EXAMPLE |
| 16 | 6 | 10 | 900 | 80 | 1999 | 99 | $1.4 \times 10^{16}$ | 2.197 | EXAMPLE |
| 17 | 7 | 26 | 950 | 66 | 1989 | 99 | $1.6 \times 10^{16}$ | 2.131 | EXAMPLE |
| 18 | | 19 | 950 | 82 | 600 | 98 | $1.5 \times 10^{16}$ | 2.081 | EXAMPLE |
| 19 | | 16 | 950 | 95 | 250 | 97 | $1.4 \times 10^{16}$ | 2.056 | EXAMPLE |
| 20 | | 14 | 950 | 69 | 52 | 96 | $1.3 \times 10^{16}$ | 2.008 | EXAMPLE |
| 21 | | 17 | 950 | 66 | 2 | 94 | $1.1 \times 10^{16}$ | 1.902 | COMPARATIVE EXAMPLE |
| 22 | | 4 | 1200 | 65 | 520 | 96 | $9.9 \times 10^{15}$ | 1.890 | COMPARATIVE EXAMPLE |
| 23 | 8 | 10 | 900 | 80 | 1996 | 99 | $1.0 \times 10^{16}$ | 1.896 | COMPARATIVE EXAMPLE |
| 24 | 9 | 10 | 900 | 80 | 2010 | 99 | $1.1 \times 10^{16}$ | 1.942 | COMPARATIVE EXAMPLE |
| 25 | 10 | 10 | 900 | 80 | 2006 | 98 | $9.9 \times 10^{15}$ | 1.865 | COMPARATIVE EXAMPLE |
| 26 | 11 | 10 | 900 | 80 | 2007 | 97 | $8.9 \times 10^{15}$ | 1.780 | COMPARATIVE EXAMPLE |

As presented in Table 2, in the samples No. 1 to No. 6, No. 10 to No. 13, and No. 16 to No. 20, since the chemical compositions were within the ranges of the present invention, and the manufacturing conditions were also within the ranges of the present invention, desired microstructures and dislocation densities were obtained in the heat-treated steel materials. Further, since the chemical compositions, the microstructures, and the dislocation densities were within the ranges of the present invention, the tensile strengths of 2.000 GPa or more were obtained.

In the samples No. 7 to No. 9, No. 14, No. 15, No. 21, and No. 22, although the chemical compositions were within the ranges of the present invention, the manufacturing conditions were out of the ranges of the present invention, and thus it was not possible to obtain desired dislocation densities. Further, since the dislocation densities were out of the ranges of the present invention, the tensile strengths were low to be less than 2.000 GPa.

In the samples No. 23 and No. 24, since the Mn contents were out of the ranges of the present invention, even though the manufacturing conditions were within the ranges of the present invention, the dislocation densities were less than $1.2\times10^{16}$ $m^{-2}$, and the tensile strengths were low to be less than 2.000 GPa.

In the sample No. 25, since the C content was out of the range of the present invention, even though the manufacturing condition was within the range of the present invention, the dislocation density was less than $1.2\times10^{16}$ $m^{-2}$, and the tensile strength was low to be less than 2.000 GPa.

In the sample No. 26, the "Expression 1" was not satisfied, so that even when the manufacturing condition was within the range of the present invention, the dislocation density was less than $1.2\times10^{16}$ $m^{-2}$, and the tensile strength was low to be less than 2.000 GPa.

From these results, it is understood that it is possible to obtain a high-strength heat-treated steel material according to the present invention. Further, according to the present invention, it is not required that C is contained to such an extent as to deteriorate the toughness and the weldability in order to obtain the high strength, so that it is also possible to obtain excellent toughness and weldability.

INDUSTRIAL APPLICABILITY

The present invention may be used in the industries of manufacturing heat-treated materials and the like used for automobiles, for example, and in the industries of using them. The present invention may also be used in the industries of manufacturing other mechanical structural components, the industries of using them, and the like.

The invention claimed is:

1. A heat-treated steel material, comprising:

a chemical composition represented by, in mass %:

C: 0.05% to 0.30%;

Si: 0.50% to 5.00%;

Mn: 2.0% to 10.0%;

Cr: 0.01% to 1.00%;

Ti: 0.010% to 0.100%;

B: 0.0020% to 0.0100%;

P: 0.050% or less;

S: 0.0500% or less;

N: 0.0100% or less;

Ni: 0.0% to 2.0%;
Cu: 0.0% to 1.0%;
Mo: 0.0% to 1.0%;
V: 0.0% to 1.0%;
Al: 0.00% to 1.00%;
Nb: 0.00% to 1.00%; and
the balance: Fe and impurities, and
a microstructure represented by
martensite: 90 volume % or more,
wherein an "Expression 1" is satisfied where [C] denotes a C content in mass %, [Si] denotes a Si content in mass %, and [Mn] denotes a Mn content in mass %, $$4612\times[C]+51\times[Si]+102\times[Mn]+605>2000 \quad \text{"Expression 1"};$$

wherein a dislocation density in the martensite is equal to or more than $1.2\times10^{16}$ $m^{-2}$; and
wherein a tensile strength is 2.000 GPa or more.

2. The heat-treated steel material according to claim 1, wherein in the chemical composition,
Ni: 0.1% to 2.0%,
Cu: 0.1% to 1.0%,
Mo: 0.1% to 1.0%,
V: 0.1% to 1.0%,
Al: 0.01% to 1.00%,
Nb: 0.01% to 1.00%, or
any combination thereof is satisfied.

3. A method of manufacturing the heat-treated steel material according to claim 1, comprising:
heating a steel sheet to a temperature zone of not less than an $Ac_3$ point and not more than the $Ac_3$ point+200° C. at an average heating rate of 10° C./s or more;
next, cooling the steel sheet from the temperature zone to an Ms point at a rate equal to or more than an upper critical cooling rate; and
next, cooling the steel sheet from the Ms point to 100° C. at an average cooling rate of 50° C./s or more,
wherein the steel sheet comprises a chemical composition represented by, in mass %:
C: 0.05% to 0.30%;
Si: 0.50% to 5.00%;
Mn: 2.0% to 10.0%;
Cr: 0.01% to 1.00%;
Ti: 0.010% to 0.100%;
B: 0.0020% to 0.0100%;
P: 0.050% or less;
S: 0.0500% or less;
N: 0.0100% or less;
Ni: 0.0% to 2.0%;
Cu: 0.0% to 1.0%;
Mo: 0.0% to 1.0%;
V: 0.0% to 1.0%;
Al: 0.00% to 1.00%;
Nb: 0.00% to 1.00%; and
the balance: Fe and impurities,
wherein an "Expression 1" is satisfied where [C] denotes a C content in mass %, [Si] denotes a Si content in mass %, and [Mn] denotes a Mn content in mass %, $$4612\times[C]+51\times[Si]+102\times[Mn]+605>2000 \quad \text{"Expression 1"}$$

wherein the heat-treated steel material has a microstructure represented by
martensite: 90 volume % or more,
wherein a dislocation density in the martensite is equal to or more than $1.2\times10^{16}$ $m^{-2}$; and
wherein a tensile strength is 2.000 GPa or more.

4. The method of manufacturing the heat-treated steel material according to claim 3, wherein in the chemical composition,
Ni: 0.1% to 2.0%,
Cu: 0.1% to 1.0%,
Mo: 0.1% to 1.0%,
V: 0.1% to 1.0%,
Al: 0.01% to 1.00%,
Nb: 0.01% to 1.00% or
any combination thereof is satisfied.

5. The method of manufacturing the heat-treated steel material according to claim 3, wherein the steel sheet is subjected to forming before the temperature of the steel sheet reaches the Ms point after the heating the steel sheet to the temperature zone of not less than the $Ac_3$ point and not more than the $Ac_3$ point+200° C.

6. The method of manufacturing the heat-treated steel material according to claim 4, wherein the steel sheet is subjected to forming before the temperature of the steel sheet reaches the Ms point after the heating the steel sheet to the temperature zone of not less than the $Ac_3$ point and not more than the $Ac_3$ point+200° C.

* * * * *